US006739162B1

(12) United States Patent
Kondratuk

(10) Patent No.: US 6,739,162 B1
(45) Date of Patent: May 25, 2004

(54) SIMPLE DEADBOLT ASSEMBLY

(75) Inventor: Michael W. Kondratuk, Cameron, WI (US)

(73) Assignee: Hardware Specialties, Inc., Spooner, WI (US)

( * ) Notice: Subject to any disclaimer, the term of this patent is extended or adjusted under 35 U.S.C. 154(b) by 0 days.

(21) Appl. No.: 10/315,201

(22) Filed: Dec. 10, 2002

(51) Int. Cl.[7] ..... E05B 65/06
(52) U.S. Cl. ..... 70/134; 70/106; 292/140
(58) Field of Search ..... 70/134, 99, 100, 70/104, 129, 106; 292/137, 159, 140, DIG. 46

(56) References Cited

U.S. PATENT DOCUMENTS

| | | | | | |
|---|---|---|---|---|---|
| 551,264 | A | * | 12/1895 | Walker | 604/256 |
| 828,780 | A | | 8/1906 | Shepard | |
| 1,060,413 | A | | 4/1913 | Augenbraun | |
| 1,114,368 | A | * | 10/1914 | Kramarczyk | 70/134 |
| 1,219,318 | A | | 3/1917 | Hyde | |
| 1,613,398 | A | | 1/1927 | Ledin | |
| 1,782,776 | A | | 11/1930 | Dowling | |
| 1,872,440 | A | | 8/1932 | Frost et al. | |
| 1,979,805 | A | * | 11/1934 | Main | 70/134 |
| 2,803,481 | A | | 8/1957 | Williams et al. | |
| 5,009,089 | A | * | 4/1991 | Lin | 70/114 |
| 5,678,432 | A | * | 10/1997 | Teskey | 70/134 |
| 5,765,410 | A | * | 6/1998 | Kwan et al. | 70/107 |
| 6,067,823 | A | | 5/2000 | Östergren | |
| 6,148,650 | A | * | 11/2000 | Kibble | 70/134 |
| 6,164,099 | A | * | 12/2000 | Sh | 70/134 |
| 6,199,922 | B1 | * | 3/2001 | Kibble | 292/140 |
| 6,443,504 | B1 | * | 9/2002 | Donald | 292/110 |
| 2003/0037578 | A1 | * | 2/2003 | LaConte et al. | 70/134 |

OTHER PUBLICATIONS

Photos attached with original application.

* cited by examiner

*Primary Examiner*—John B. Walsh
(74) *Attorney, Agent, or Firm*—Moss & Barnett; Glen E. Schumann

(57) ABSTRACT

The present invention comprises a simple deadbolt assembly for hinged doors. The deadbolt assembly includes a deadbolt slideably mounted between two side plates for movement between an extended position and a retracted position. A cam is rotatably mounted between the side plates and actuates movement of the deadbolt upon rotation of the cam. The cam is mounted through an elongated opening in the deadbolt and includes an actuating arm with a guide. The guide is positioned within a corresponding guide channel formed in the deadbolt. Upon rotation of the cam, the guide is rotated through the guide channel and the force of the cam guide is transferred to the deadbolt causing the deadbolt to move between its extended and retracted positions. Opposing leaf springs are mounted to the deadbolt, along the length of the elongated opening to engage the cam and prevent binding between the cam and deadbolt during actuation of the deadbolt. The leaf springs further compensate for imprecise manufacturing tolerances as well as varying loads on the deadbolt.

7 Claims, 8 Drawing Sheets

SIMPLE DEADBOLT ASSEMBLY

FIELD OF INVENTION

The present invention relates to a simple deadbolt assembly for a hinged door. The deadbolt assembly includes a deadbolt, cam and opposing slide plates. The deadbolt is slideably mounted between the slide plates for movement between an extended position and a retracted position. The cam is rotatably mounted between the slide plates in engagement with the deadbolt, such that upon rotation of the cam, the deadbolt is actuated between the extended and retracted position. Leaf springs are utilized to support the deadbolt on the cam. The flexibility of the leaf springs eliminates bind between the deadbolt and the cam and results in a more fluid movement of the deadbolt.

RELATED ART

Deadbolt lock assemblies are typically utilized to prevent unauthorized opening of a door. With storm doors, the deadbolt assembly is mounted on the interior side of a door; with mortise locks, the deadbolt assembly is mounted within the edge of a door (the "mortise"), connected to a key cylinder body located on the exterior side of a door and/or a thumb turn button located on the interior side of the door by a spindle. Once a deadbolt is actuated to a locked position, it is desirable that the deadbolt not be inadvertently retracted, such as by application of an inward force on the deadbolt because this may create a condition known as "lock-out."

The distance a deadbolt extends outwardly from the door faceplate and extends into a bore formed in the doorjamb (known as "throw") varies. If the doorjamb is not properly prepared and provides too shallow a bore for receiving the deadbolt, the deadbolt may not fully extend. If the deadbolt is actuated by a key cam, the operator may not be able to lock the door, or the operator may not be able to retrieve the key because the deadbolt is not fully extended. Under these circumstances, the operator may attempt to force rotation of the key cam to obtain full extension of the deadbolt, causing the key cam to rotate out of engagement with the deadbolt. If the deadbolt partially retracts, the key cam may no longer be aligned for engagement with the deadbolt, so that the deadbolt cannot be fully retracted or extended. When this occurs, the door cannot be unlocked, constituting a "lock-out" situation. The only way to open a door under these circumstances is to remove the entire door, sometimes requiring the destruction of the door and/or lock.

A conventional design of a mortise deadbolt assembly consists of a deadbolt, side plates, a cam, a spring loaded position stop, detail in a side plate defining a guide path, and cam stops. The deadbolt is slideably mounted on the side plate for movement between an extended (locked) position and a retracted (unlocked) position. The cam is rotatably mounted to and between the side plates in engagement with the deadbolt for actuation of the deadbolt between its extended position and retracted position upon rotation of the cam.

The deadbolt is normally constrained in its extended position or retracted position by a spring loaded position stop mounted on the deadbolt for movement generally transverse to the line of motion of the deadbolt. The position stop is aligned with and extends through an opening formed in a side plate, defining a guide path for the stop. The guide path typically has an upside down "U" shape. The "legs" of the upside down U-shaped guide path reflect the retracted and extended positions of the deadbolt. When the stop is positioned in one of the two legs of the guide path, the deadbolt is fixed in its retracted position; when the stop is positioned in the other of the two legs of the guide path, the deadbolt is fixed in the extended position. Movement of the stop along the guide path between the legs permits the deadbolt to be moved between the extended and retracted positions by the cam.

The position stop is secured to a spring mounted to the deadbolt. Upon rotation of the cam, the cam engages the stop and the deadbolt. The force of the cam acting on the position stop causes the position stop to move up along one leg of the guide path as the deadbolt is transversely moved between the retracted and extended positions. As the deadbolt is moved to its new position, the position stop continues to travel through the guide path and down the second leg of the guide path, securing the deadbolt in its new position.

Cam stops are designed to limit the occurrence of lock-out situations by being strategically placed to limit rotation of the cam. Limiting rotation of the cam prevent the cam from completely disengaging the deadbolt. While cam stops provide more flexibility in the manufacturing process, if the dimensions, placement and tolerances of the position stop and guide path are not confined to strict requirements, it can still lead to lock-out, and even if strict requirements are maintained, the stops and guide path are subject to wear.

Under lock-out situations, the cam disengages the deadbolt and position stop while the position stop has not yet become constrained in one of the legs of the guide path. Minor inward forces on the deadbolt allow the deadbolt to slide inward so that the deadbolt is only partially extended, and the cam cannot re-engage the deadbolt and position stop to either extend or retract the deadbolt.

Thus, there is a need to develop a deadbolt lock assembly where lock-out is prevented. There is also a need to develop a deadbolt that cannot be inadvertently retracted from its locked or extended position.

BRIEF SUMMARY OF THE INVENTION

The present invention comprises a simple deadbolt that may be utilized as a surface lock typically provided with storm doors, or as part of a mortise door lock system. The simple deadbolt assembly is small allowing it to be used in most existing door applications. The simple deadbolt includes a lock body comprised of opposing side plates. A deadbolt is slideably mounted between the side plates for movement between a retracted position and an extended position. A key cam is rotatably mounted between the side plates and slideably supports the deadbolt and actuates movement of the deadbolt between the retracted position and extended positions upon rotation of the cam.

The key cam includes a cylindrical axle or shank with an actuating arm extending radially there from. The actuating arm supports a cylindrical guide at its outer end. The deadbolt includes a elongated opening for slideably receiving the cylindrical axle of the cam, and a guide channel contiguous and substantially perpendicular to the elongated opening for receiving the key cam guide. The key cam cylindrical axle is mounted within the opening of the deadbolt and is supported by opposing leaf springs mounted on the deadbolt along the longitudinal edges of the elongated opening.

The guide channel and deadbolt opening create a guide path for the cam guide. The guide extends into the guide channel and opening. Upon rotation of the key cam by a thumb turn button or key cylinder operatively connected thereto, the guide is rotated through the guide channel, applying a force to the side walls of the deadbolt that define the guide channel. the force of the cam arm being rotated into engagement with the deadbolt causes the deadbolt to slide between its extended and retracted positions. The leaf springs permit fluid movement of the deadbolt with respect to the cam and reduce wear.

These features of novelty and various other advantages that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE INVENTION

The present invention of a simple deadbolt assembly will be described as it applies to its preferred embodiment. It is not intended that the present invention be limited to the described embodiment. It is intended that the invention cover all modifications, equivalents and alternatives which may be included within the spirit and scope of the invention.

Figure 1:
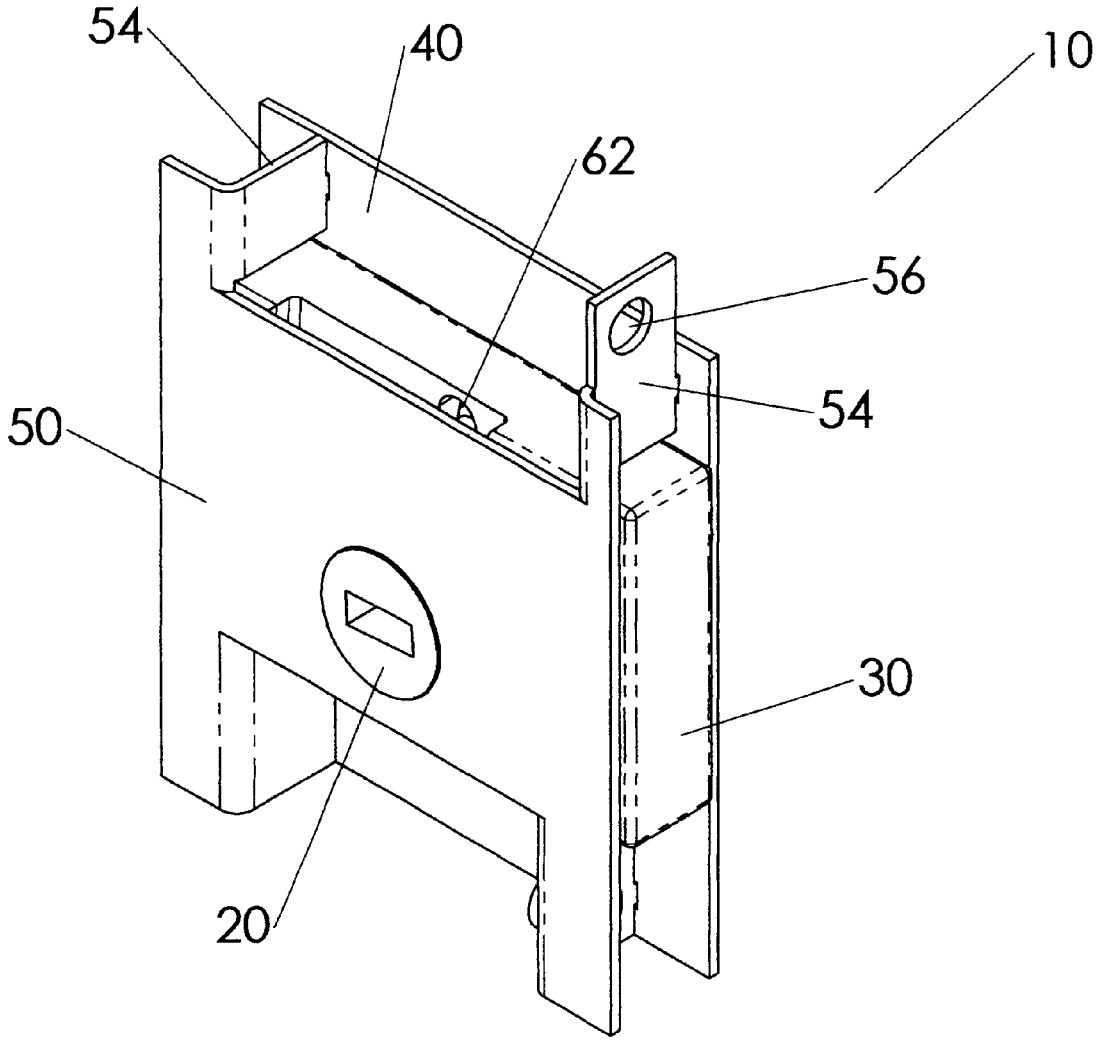
FIG. 1 is a perspective view of a preferred embodiment of the simple deadbolt in the retracted (unlocked) position.

Referring now to the drawings, wherein like reference numerals and letters indicate corresponding structure throughout the several views, and referring in particular to FIG. 1, there is shown a simple deadbolt assembly 10 according to the present invention. The simple deadbolt assembly 10 is designed for installation as a surface lock or as part of a mortise lock assembly.

The simple deadbolt assembly 10 is comprised of a key cam 20, a deadbolt 30, and opposing side plates (including a slide plate 40 and a connect plate 50). The deadbolt 30 is slideably mounted between the slide plate 40 and connect plate 50 for movement between a retracted position and an extended position. The key cam 20 is rotatably mounted between the slide plate 40 and connect plate 50 (FIG. 1) and actuates movement of the deadbolt 30 between the retracted (unlocked) position (FIG. 2) and an extended (locked) position (FIG. 3).

Figure 4:
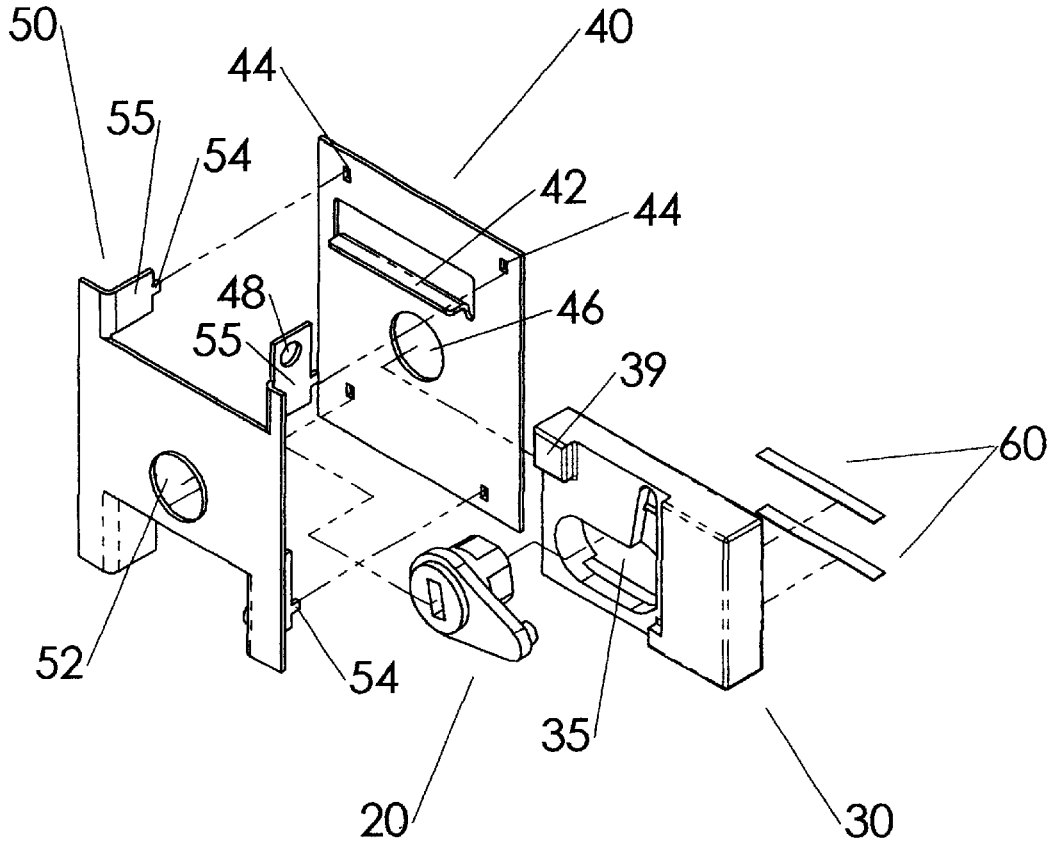
FIG. 4 is an exploded perspective view of the various components constituting a preferred embodiment of the simple deadbolt assembly.
Figure 5:
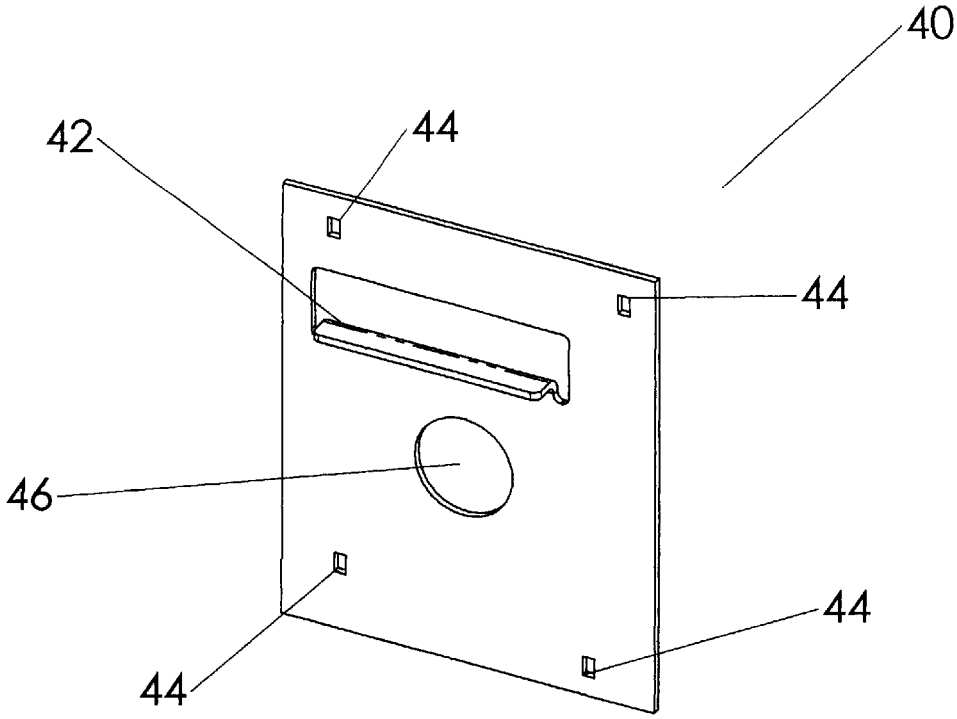
FIG. 5 is a perspective view of one of the side plates (slide plate) of the simple deadbolt assembly.

Referring to FIGS. 4 and 5, the slide plate 40 includes a slide member 42 for slideably supporting the deadbolt 30 for movement between the retracted and extended positions. The slide plate 40 also includes a cam opening 46 for rotatably receiving the cam 20. Attachment openings 44 are designed to engage the attachment tabs 54 of support members 55 of connect plate 50. Some support members 55 of connect plate 50 are equipped with a mount hole 48 utilized when securing the assembled deadbolt assembly 10 to a door (for example, with a screw).

Figure 10:
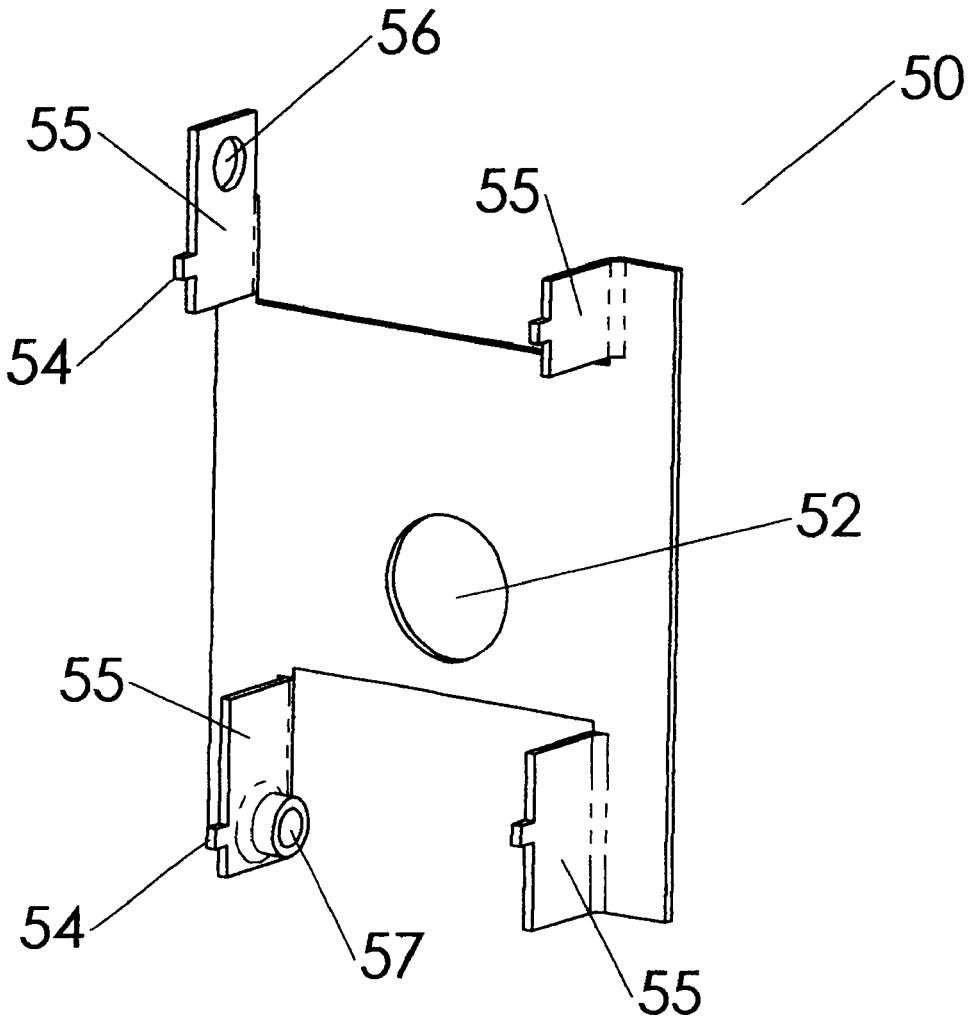
FIG. 10 is a perspective view of a second side plate (connect plate) of the simple deadbolt assembly.

Referring to FIGS. 4 and 10, connect plate 50 includes support members 55 defining attachment tabs 54 for engaging corresponding attachment openings 44 in slide plate 40. One of the support members 55 defines a mount hole 56; another support member 55 defines a threaded or tubular or threaded mount hole 57 that may be used to receive a fastener, such as a screw or rivet. Connect plate 50 also includes an cam opening 52 for rotatably receiving an end of the key cam 20.

When connect plate 50 and slide plate 40 are secured together, they form a housing for the deadbolt 30 and cam 20.

Figure 7:
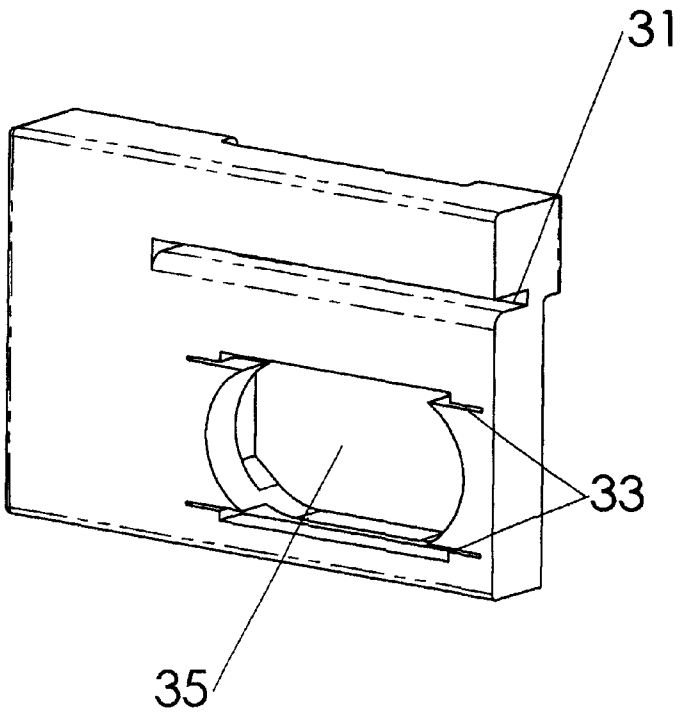
FIG. 7 is a perspective view of the deadbolt member, from a side opposite that shown in FIG. 6.
Figure 8:
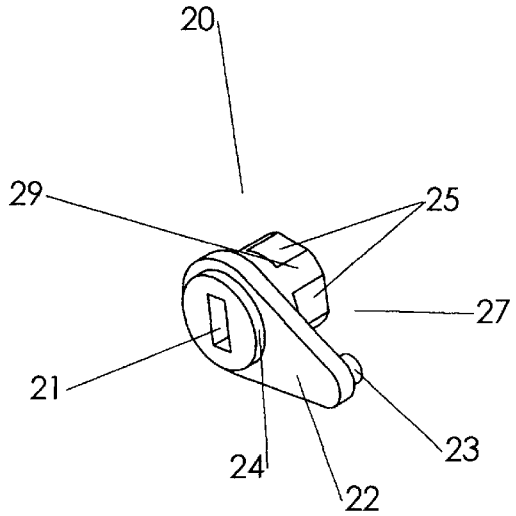
FIG. 8 is a perspective view of the cam component of the simple deadbolt assembly.
Figure 9:
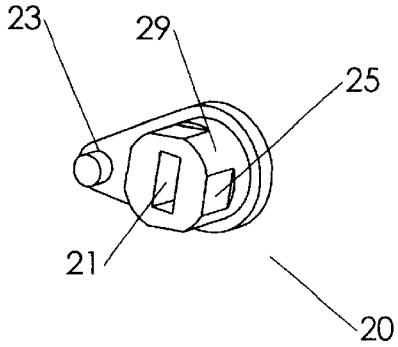
FIG. 9 is a perspective view of the cam component of the simple deadbolt assembly, of a side opposite that shown in FIG. 8.

Referring to FIGS. 8 and 9, the cam 20 generally includes generally cylindrical, opposing axles 27 and 24, a radially extending actuating arm 22 defining a cylindrical guide 23 at its out end, and a spindle opening 21. Cam 20 is rotatably mounted between the slide plate 40 and connect plate 50, with axle 27 extended through and rotatably supported in cam opening 46 of connect plate 40 and with axle 24 partially extending through and rotatably supported in cam opening 52 of slide plate 50. When assembled, the longer axle 27 of key cam 20 extends through an elongated opening 35 of deadbolt 30 (see FIGS. 6 and 7), and slideably supports deadbolt 30 within the housing defined by assembled slide plate 40 and connect plate 50. The key cam 20 can be rotated between a locked and an unlocked position. In the unlocked position, the actuating arm 22 is rotated to a position substantially perpendicular to the line of motion of the deadbolt 30, as shown in FIG. 3. In the locked position, the actuating arm 22 is rotated to a position over center of the line of motion of the deadbolt 30 extended from the center of the key cam 20. In the over center position (rotated from the unlocked position to a position beyond the line of motion of deadbolt 30 extended from the center of the key cam 20), the actuating arm 22 prevents inward movement of the deadbolt 30 as the result of any inward force applied to the deadbolt 30.

The axle 27 includes pairs of diametrically opposed, alternating flat surfaces 25 and cylindrical surfaces 29. The flat surfaces 25 are strategically placed so that when the cam 30 is rotated to the locked and unlocked positions, two diametrically opposed flat surfaces 25 are engaged between and substantially mated with the leaf springs 60 positioned along the substantially flat, opposing surfaces 38 of deadbolt opening 35. When the deadbolt 30 is in its extended position, any inward pressure on the deadbolt 30 that is translated to the cam 20 will have the potential for causing cam 20 to rotate counterclockwise to the unlocked position (as viewed in FIG. 2). The engagement of the flat surfaces 25 with the leaf springs 60 create resistance to such forces, and help maintaining the deadbolt 30 in its locked position. Additionally, the flat surfaces 25 also provide a "click" feel to the key cam 20 when rotated to a extended and retracted positions, which lets the key operator receive a sensual feel or confirmation that the lock is fully engaged or disengaged.

The spindle opening 21 is designed to receive a spindle (not shown) for connection with a key cylinder or thumb turn knob (not shown).

Figure 6:
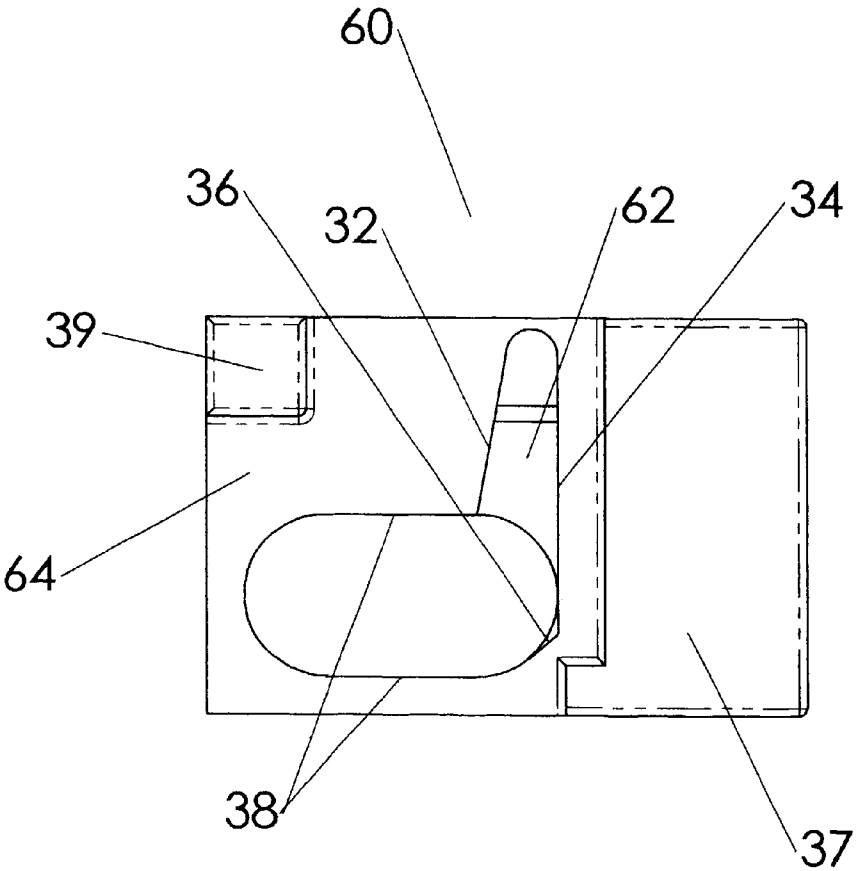
FIG. 6 is a side view of the deadbolt member of the simple deadbolt assembly.

Referring to FIGS. 6 and 7, the deadbolt 30 includes a elongated opening 35 for slideably receiving the axle 27 of key cam 20, and a bolt head 37 defined at one end. On a first side of the deadbolt 30 (FIG. 6), the deadbolt 30 is formed (machined, molded or created by some other process) to define a recessed area 64 to accommodate the actuating arm 22 of the cam 20, so that the actuating arm 22 is flush with the original width of the deadbolt 30. A guide channel 62 is formed contiguous with and substantially perpendicular in alignment with the elongated opening 35 of deadbolt 30 for receiving the guide 23 of cam actuating arm 22. The combined peripheral surfaces of the channel 62 (lead edge 34 continuing to trailing edge 32 shown in FIG. 6) define a guide path along which the cam guide 22 travels.

One corner of the deadbolt 30 adjoining the recessed area 64 remains at full width, creating a skid surface 39. The skid surface 39 extends to the full width of the deadbolt head 37 and allows the deadbolt 30 to move smoothly between the retracted position and extended position within the housing created by slide plate 40 and connect plate 50. The recessed area 64 provides sufficient space for free rotation of the actuating arm 22.

On an opposite side of deadbolt 30 is defined a slide groove 31 for slideably receiving slide member 42 of slide plate 40, and two leaf spring support grooves 33 for supporting leaf springs 60. The slide member 42 slideably supports deadbolt 30 during operation and defines a line of motion of the deadbolt 30 when actuated between its retracted position and extended position upon rotation of the key cam 20. The leaf springs 60 support the deadbolt 30 on cam axle 27, allowing longitudinal movement of the deadbolt 30 with respect to the key cam 20, and rotation of key cam 20 within and with respect to the elongated opening 35 of deadbolt 30. When the deadbolt assembly 10 is assembled, the support members 54 provide structure for the housing, but do not support the deadbolt 30.

The radially extending actuating arm 22 of cam 20 supports cylindrical guide 23. The guide 23 extends into the guide channel 62. Upon rotation of the key cam 20 by a thumb turn button or key cylinder (not shown) operatively connected thereto, the guide 23 engages the trailing edge 32 and leading edge 34 of the guide channel 62 (creating a deadbolt/cam interface) and translates the movement of the actuating arm 22 to the deadbolt 30, causing the deadbolt 30 to slide between its retracted and extended positions.

Figure 2:
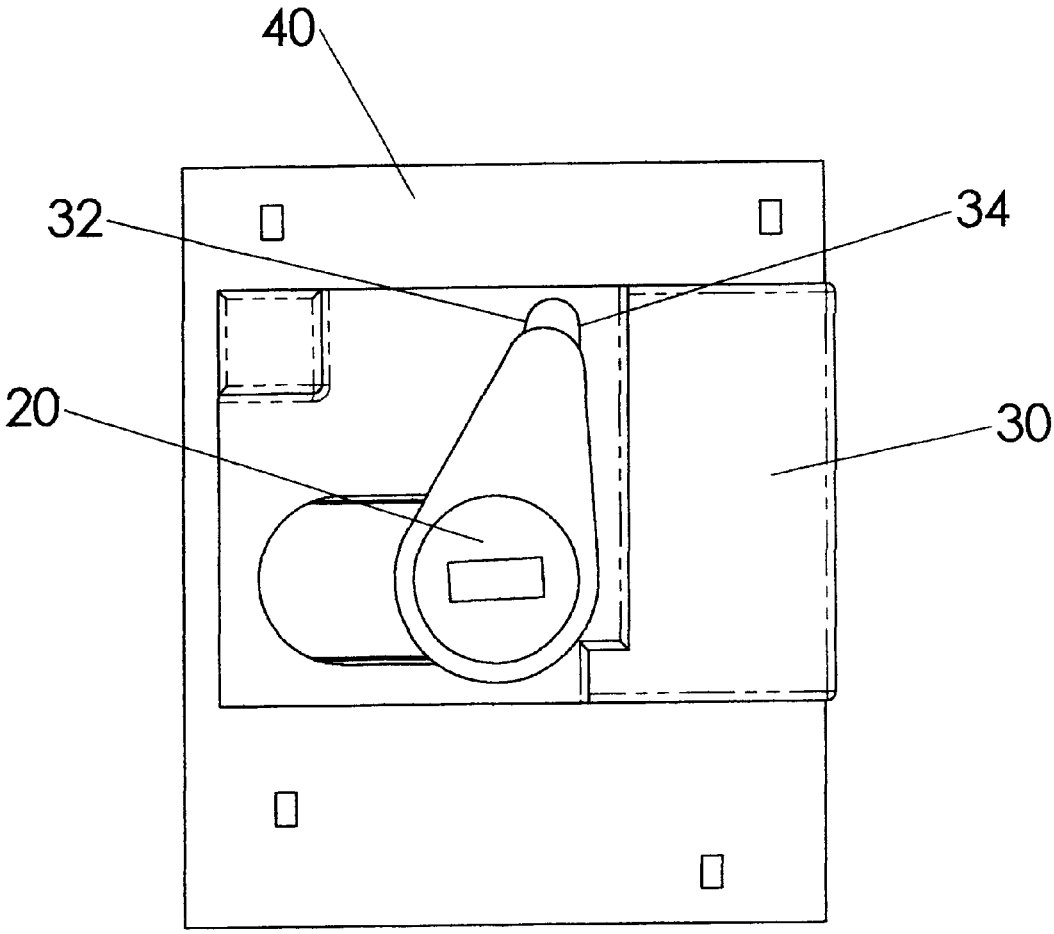
FIG. 2 is a side view of the simple deadbolt with a side plate removed, illustrating the deadbolt in the retracted position.
Figure 3:
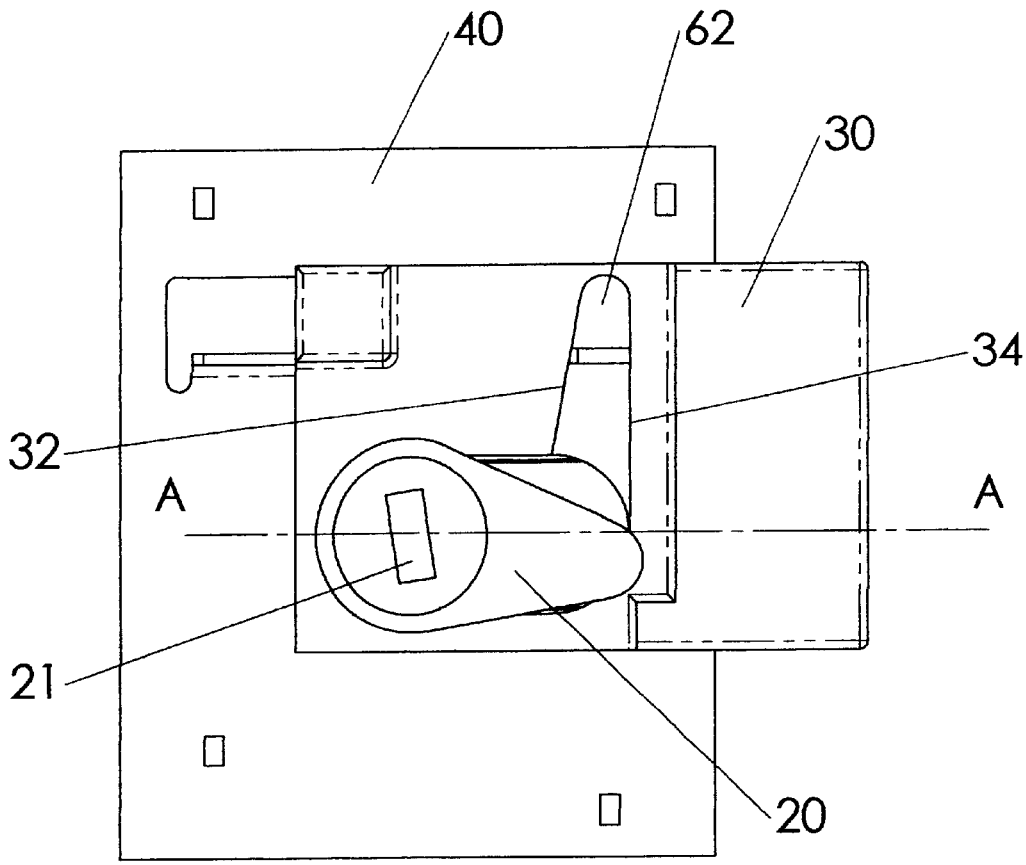
FIG. 3 is a side view of the simple deadbolt with a side plate removed, illustrating the deadbolt in the extended (locked) position.

The deadbolt 30 is shown in the retracted or unlocked position in FIG. 2. As viewed in FIG. 2, when key cam 20 is rotated clockwise, the guide travels down guide channel 62 into engagement with leading edge 34 of guide channel 62. The rotational force of cam 20 is translated to the deadbolt 30, causing the deadbolt 30 to slide to its extended position, with the deadbolt head 37 extended from the housing of the lock assembly 10. The cam 20 is rotated until guide 23 engages a recess or stop 36 along elongated opening 35. At this point, deadbolt 30 is fully extended, and deadbolt 30 cannot be inadvertently retracted thereafter because the deadbolt 30 interface with the key cam 20 (the point of contact between the guide 23 and deadbolt stop 36) becomes toggled over a line drawn from the cam center parallel to the line of motion of the deadbolt 30, as shown by line A—A in FIG. 3. When so toggled, any inward load applied to the extended deadbolt 30 results in loading attempting to rotate the cam in a further locked direction (clockwise as shown in FIG. 3). Recess 36 is incorporated in the design to keep the cam toggled at nearly the toggle position with the cam/deadbolt interface aligned with line A—A. This geometry allows a true deadbolt configuration.

Referring to FIG. 3, to retract the deadbolt 30 from its extended position, cam 20 is rotated counterclockwise, causing cam guide 23 to engage trailing edge 32 of channel 62. The rotational force of cam 20 is translated to the deadbolt 30, causing the deadbolt 30 to slide back to its retracted position, with the deadbolt head 37 withdrawn into the housing of the lock assembly 10. When the deadbolt 30 is fully withdrawn, another pair of diametrically opposed flat surfaces 25 on axle 27 are engaged between leaf springs 60, to retain the orientation of cam 20 in the retracted position within opening 35 of the deadbolt 30. There is no possibility of lock-out, since the guide 23 is inextricably engaged within the guide path defined by guide channel 62 and opening 35.

The opposing leaf springs 60 flexibly grip the cam axle 27 and permit the deadbolt 30 to slide between its retracted and extended positions without binding during operation. Without the leaf springs 60, the deadbolt 30 would ride on key cam 20 as key cam 20 is rotated, creating friction between and wear and tear on the surfaces the key cam axle 27 and the surfaces 38 of deadbolt 30. Because of the flexibility of the leaf springs 60, the leaf springs 60 remain in contact with the cam axle 27 regardless of loading on the deadbolt 30 or fluctuations in manufacturing tolerances when the deadbolt assembly 10 is constructed.

A means to hold the deadbolt 30 in its retracted and extended positions or to hold the key cam 20 in its locked or unlocked positions can be employed by the addition of a spring or some other biasing or holding method. A spring mechanism is not required, but would prevent accidental extension of the deadbolt 30.

The various components of the lock assembly 10 can be prepared utilizing various materials and various processes to maximize performance. For instance, components may be created through molding, stamping, melting or forming, and be constructed using metal, powdered metal, plastic or other materials. For instance, a deadbolt might be constructed of powdered metal and oiled, for self lubrication, with a plastic tip applied to minimize friction and wear with respect to a door jam lock plate. The unique combination of these materials provides performance advantages over the prior art.

The present invention has the further advantage of eliminating the position stop and deadbolt spring required by the conventional design, as well as the need for the cam stops and the interconnection details between the position stop and side plates, all of which are required to make the conventional deadbolt a true deadbolt (retractable only on demand). Another advantage of the present invention is the elimination of strict tolerance requirements normally required in the manufacturing process to assure proper actuation of the deadbolt assembly, thus reducing manufacturing costs. Most importantly, this invention eliminates the possibility of a "lock-out" situation where a user cannot actuate the deadbolt when it is partially extended.

What is claimed is:

1. A deadbolt lock assembly comprising:

a. a pair of side plates;

b. an elongated deadbolt a having longitudinal cam slot and a guide channel contiguous with and extending substantially transversely from the cam slot, the deadbolt being slideably mounted between the side plates for movement between an extended position and a retracted position;

c. a cam having a guide, the cam being rotatably mounted between the side plates through the cam slot of the deadbolt, with the guide in engagement with the guide channel of the deadbolt, such that upon rotation of the cam, the guide operatively engages the deadbolt to actuate the deadbolt between its extended and retracted positions; and d. a first spring means mounted along a first edge of the cam slot in the deadbolt for slideably engaging the cam; and e. a second spring means mounted along a second edge of the cam slot of the deadbolt, opposite the first edge, for slideably engaging the cam.

2. A deadbolt lock assembly comprising:

a. a pair of side plates;

b. a deadbolt having an elongated slot for receiving a cam and a guide channel contiguous to and substantially transversely extending from the cam slot, wherein the deadbolt is slideably mounted between the side plates for movement between an extended position and a retracted position;

c. a cam having a radially extending actuating arm supporting a cam guide, wherein the cam is rotatably mounted between the side plates through the cam slot of the deadbolt with the cam guide extended into the guide channel of the deadbolt, such that upon rotation of the cam, the cam guide operatively engages the deadbolt to actuate the deadbolt between its extended and retracted positions;

d. a first spring means mounted along a first edge of the cam slot in the deadbolt for slideably engaging the cam; and e. a second spring means mounted along a second edge of the cam slot of the deadbolt, opposite the first edge, for slideably engaging the cam.

3. The deadbolt lock assembly of claim 2 further comprising:

a. a notch formed in the guide channel, strategically placed such that upon rotation of the cam guide to cause the deadbolt to move to its extended position, the guide engages the notch to lock the deadbolt in its extended position.

4. The deadbolt lock assembly of claim 3 wherein the cam includes an opening for receiving a spindle.

5. The deadbolt lock assembly of claim 2 wherein the first and second spring means are leaf springs and the cam has a generally cylindrical shape with diametrically opposed alternating flat and cylindrical surfaces that engage the leaf springs.

6. The deadbolt lock assembly of claim 2 wherein:

a. one side plate includes a slide member for slideably supporting the deadbolt and an opening for rotatably receiving the cam;

b. the deadbolt includes a slide channel for receiving the slide member; and c. a second side plate includes an opening for rotatably receiving the cam.

7. The deadbolt lock assembly of claim 2 wherein the first spring means and second spring means are both leaf springs.

* * * * *